US006325427B1

(12) United States Patent
Daoud

(10) Patent No.: US 6,325,427 B1
(45) Date of Patent: Dec. 4, 2001

(54) LOCKING MECHANISM

(75) Inventor: Bassel Hage Daoud, Parsippany, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/163,701

(22) Filed: Sep. 30, 1998

(51) Int. Cl.[7] ..... E05C 19/10
(52) U.S. Cl. ..... 292/27; 292/98; 220/325
(58) Field of Search ..... 292/11, 27, 49, 292/56, 98, 215, 197, 245; 220/326, 325; 70/137, 123

(56) References Cited

U.S. PATENT DOCUMENTS

| | | | | |
|---|---|---|---|---|
| 412,988 | * | 10/1889 | Schumann | 292/27 |
| 943,127 | * | 12/1909 | Van Boven | 292/27 X |
| 1,272,590 | * | 7/1918 | Wightman | 292/27 X |
| 2,118,729 | * | 5/1938 | Hogan | 292/27 |
| 2,248,005 | * | 7/1941 | Lyman | 292/27 X |
| 3,857,594 | * | 12/1974 | Pastua, Jr. | 292/27 |
| 4,500,120 | * | 2/1985 | Ridgewell et al. | 292/19 |
| 5,209,530 | * | 5/1993 | Kulloch | 292/27 |
| 5,562,317 | * | 10/1996 | Kuo et al. | 292/359 |
| 5,915,766 | * | 6/1999 | Baumeister et al. | 292/341.15 |

FOREIGN PATENT DOCUMENTS

| | | | | |
|---|---|---|---|---|
| 87910 | * | 1/1921 | (CH) | 292/27 |
| 156694 | * | 11/1932 | (CH) | 292/27 |
| 511208 | * | 12/1920 | (FR) | 292/27 |
| 2983 | * | 5/1902 | (GB) | 292/27 |
| 372878 | * | 5/1932 | (GB) | 292/27 |
| 800 955 | * | 9/1958 | (GB) | 292/27 |
| 464028 | * | 6/1951 | (IT) | 292/27 |

* cited by examiner

*Primary Examiner*—Teri Pham Luu
(74) *Attorney, Agent, or Firm*—Howard C. Miskin; Gloria Tsui-Yip

(57) ABSTRACT

A locking mechanism for a box having a cover and a base hingeably connected to each other. The locking mechanism comprises a cover latching mechanism and a base latching mechanism. The cover latching mechanism is in a latching position. The two latching mechanisms are in latching engagement with each other to lock the box closed. An unlatching mechanism is provided which is activated to place the latching mechanism in an unlatching position to disengage the latching mechanisms from each other and unlock the box. An activating mechanism to active the unlatching mechanism. A deactivating mechanism is provided to return the cover latching mechanism back to its latching position so that closing the cover will cause the latching mechanisms to become in locking engagement with each other to lock the box. A box opening assembly in the box which is adapted to open the cover as soon as the latching mechanisms are disengaged from each other.

21 Claims, 17 Drawing Sheets

LOCKING MECHANISM

FIELD OF THE INVENTION

The present invention relates to locking mechanisms and more particularly to a locking mechanism for automatically locking boxes for electrical components, such as junction boxes.

BACKGROUND

Junction boxes usually have a cover and a base which are hinged together. It often happens that the cover is closed over the base but is left unlocked. This may permit access to the interior of the unlocked box by people and animals and/or may permit water, dust, etc. to enter the box, thereby possibly causing damage to the components therein. In addition, such boxes are often made without handles which makes it difficult to pry open the box.

It is therefore desirable to provide an automatic locking mechanism for such boxes which would require a tool to open the box but which would not require a tool to lock the box. The box would automatically lock as soon as the cover is closed. It is also desirable to provide a mechanism which would open the box as soon as the cover is unlocked.

SUMMARY OF THE INVENTION

The present invention overcomes these difficulties and provides an improved locking mechanism for a box which will ensure that the box is automatically locked as soon as the cover is closed and which will automatically open the cover when the box is unlocked. The automatic locking mechanism may comprise a pair of resilient latch arms with a lock prong at the end of each. The lock prongs will automatically enter into retaining grooves when the cover is closed to lock the box. A control cam is provided adjacent to the latch arms which is rotated to spread the latch arms and move the lock prongs out of the retaining grooves thereby unlocking the box and permitting the cover to be opened. A spring may be positioned under the cover so that as soon as the box is unlocked the cover will pop open. After the box is unlocked, the control cam is released and a wind-up spring is provided to rotate the control cam away from the latch arms so that the latch arms can assume their original position. When the cover is closed, the lock prongs on the latch arms will again enter the retaining grooves to automatically lock the box.

DRAWINGS

A preferred embodiment of the invention has been chosen for purposes of illustration and description and is shown in the accompanying drawings forming a part of the specification wherein.

Figure 13:
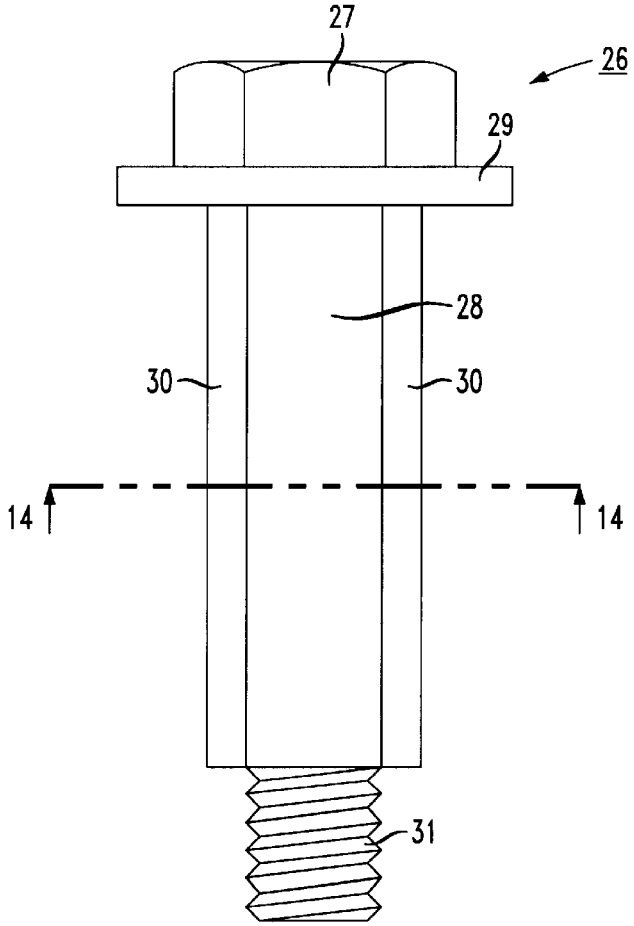

FIG. 13. is a plan view of the control bolt used in connection with the present invention.

Figure 14:
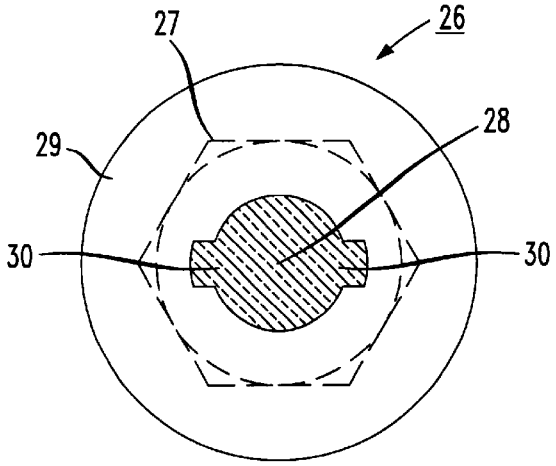

FIG. 14 is a sectional view taken along line 14—14 of FIG. 13.

Figure 12:
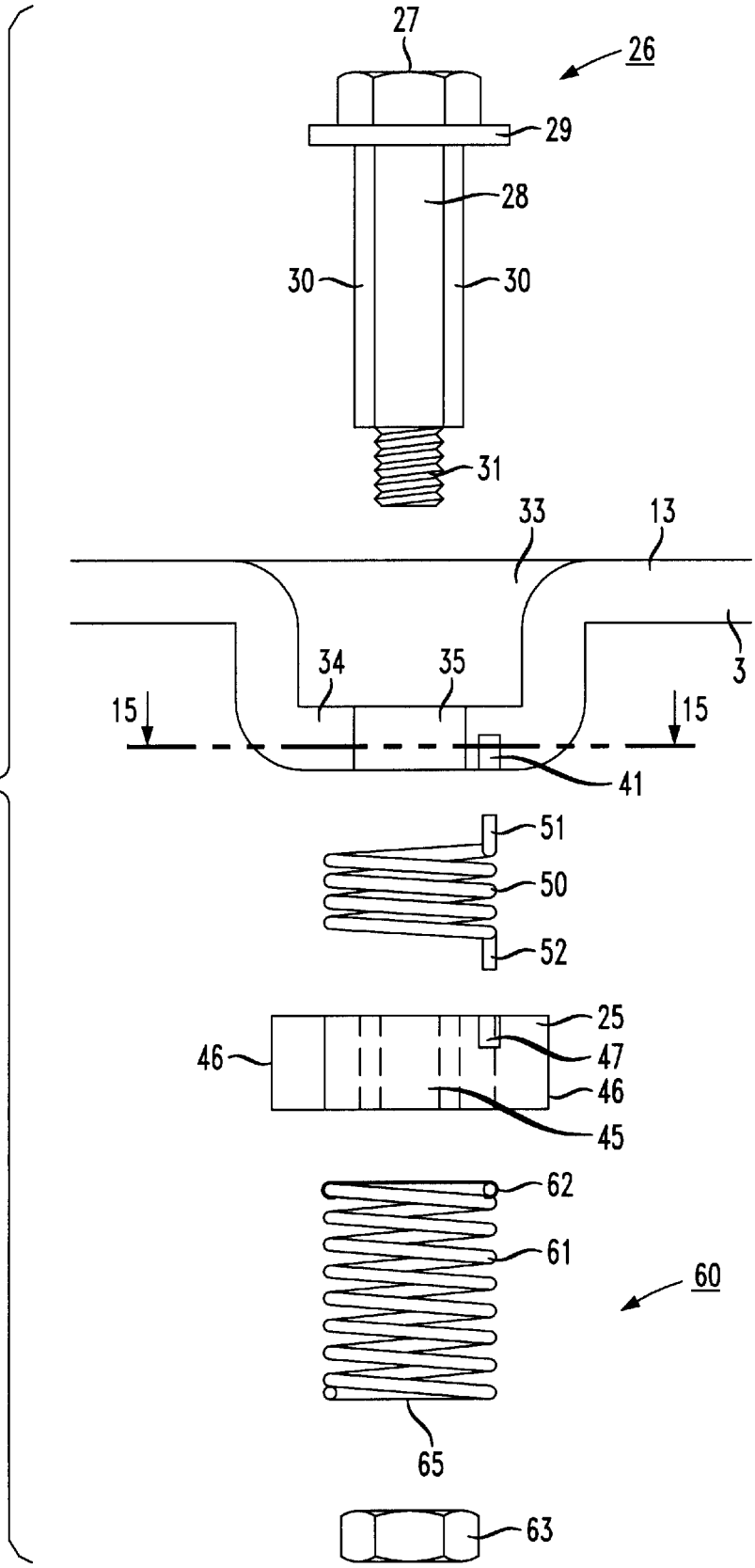
FIG. 12 is an exploded view of the control mechanism for the locking assembly of the present invention.
Figure 15:
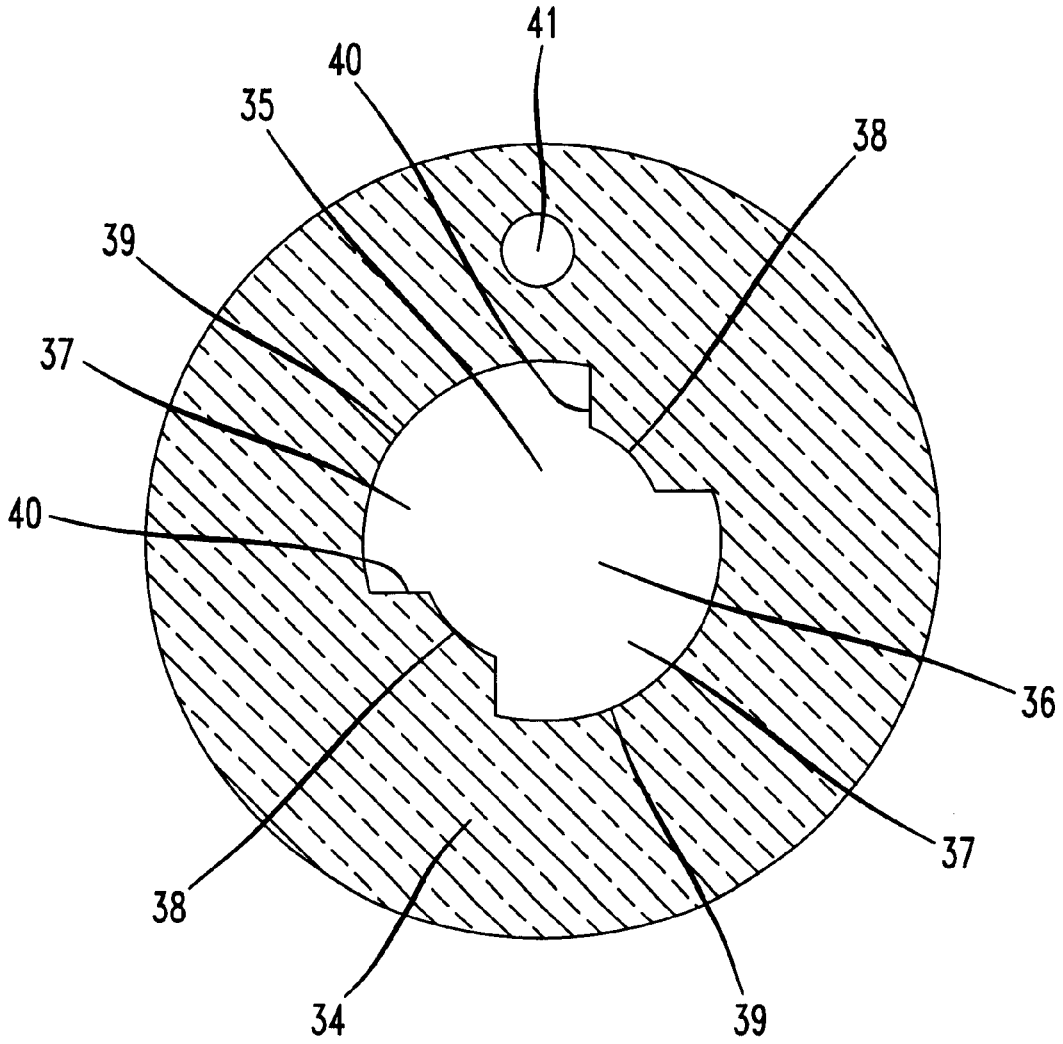

FIG. 15 is a sectional view taken along line 15—15 of FIG. 12.

Figure 16:
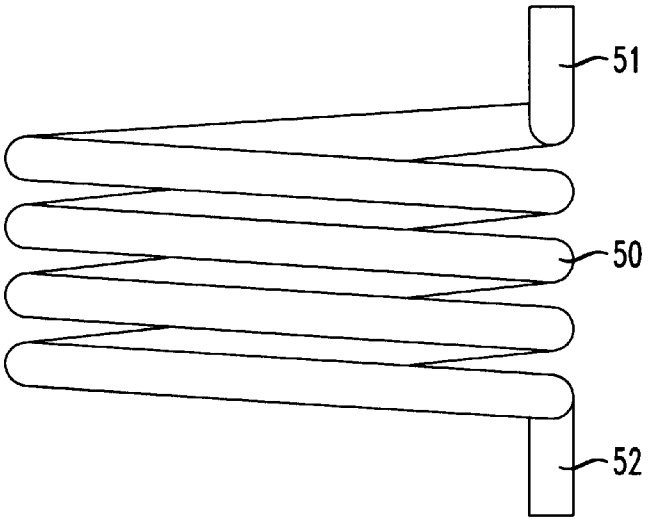

FIG. 16 is a side elevational view of the wind-up spring used with the present invention.

Figure 17:
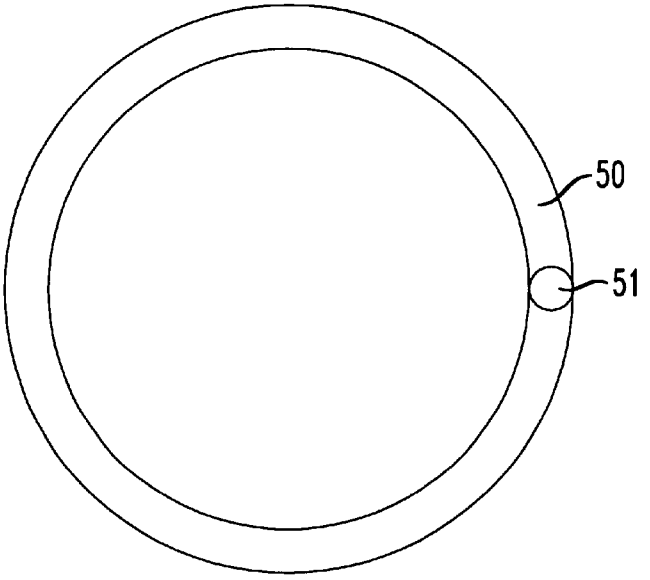

FIG. 17 is a top view thereof.

Figure 18:
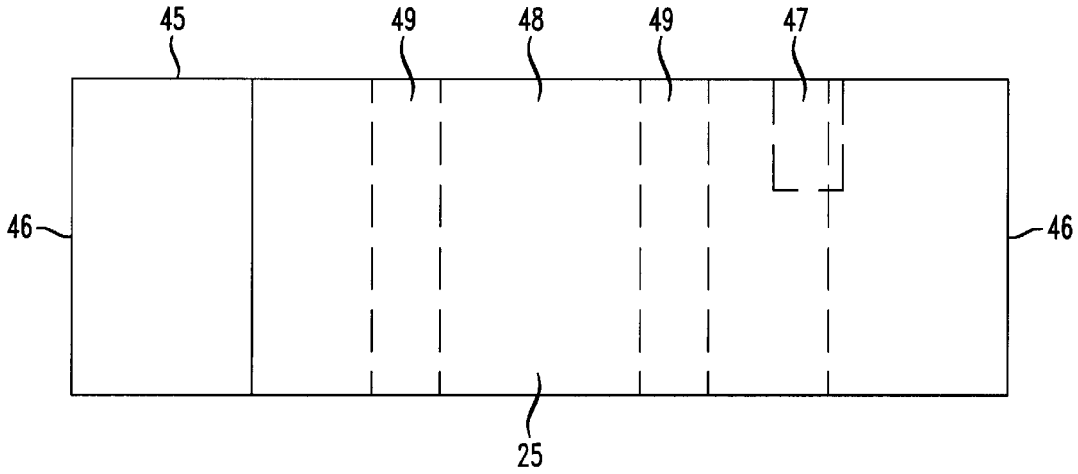

FIG. 18 is a side elevational view of the control cam used in the control mechanism of the present invention.

Figure 19:
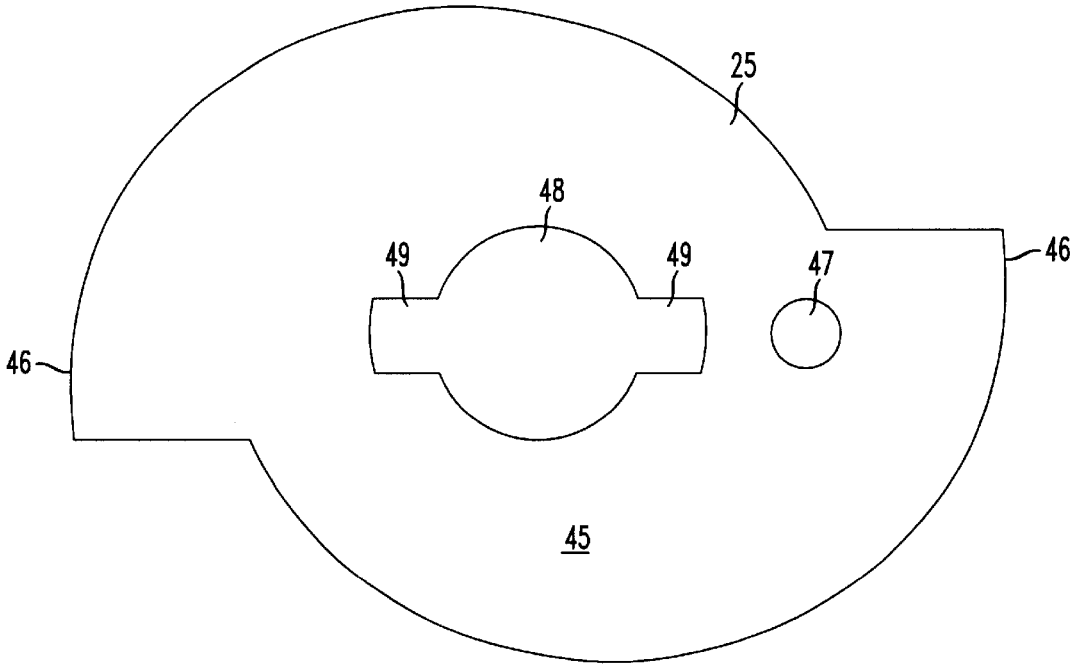

FIG. 19 is a top view thereof.

Figure 20:
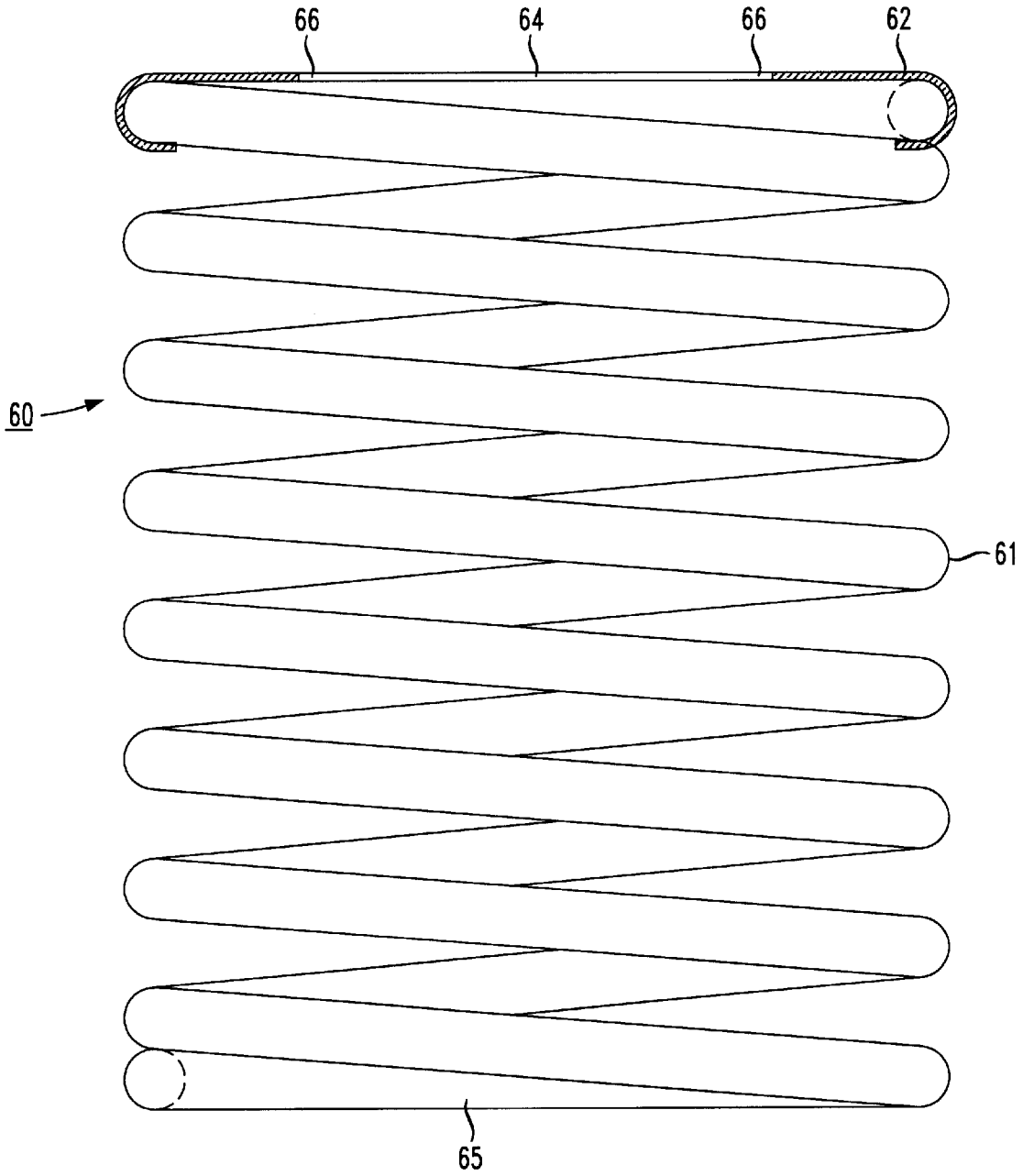

FIG. 20 is a side elevational view partially in a section of the pop-up spring assembly used with the present invention.

Figure 21:
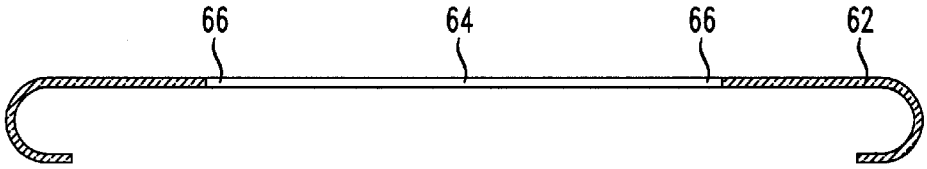

FIG. 21 is a sectional view showing the holding plate of the pop-up spring.

Figure 22:
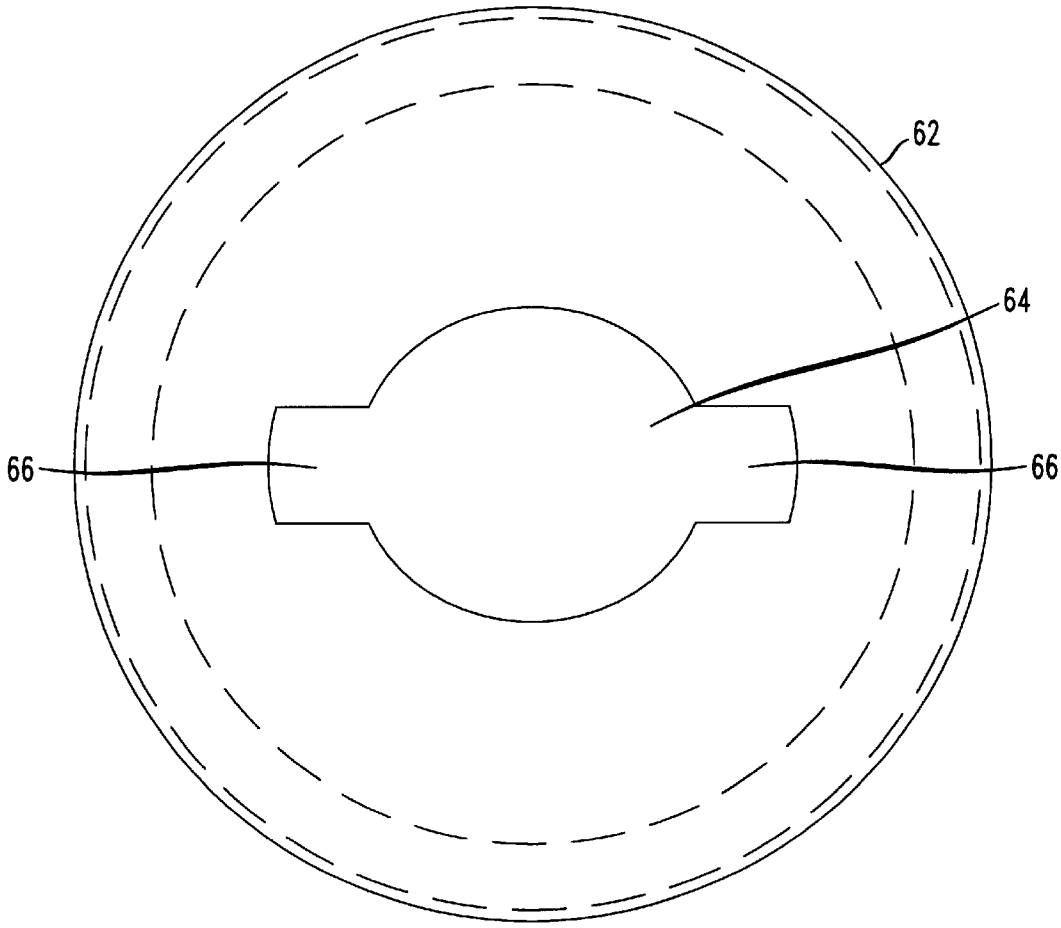

FIG. 22 is a top view thereof.

Figure 23:
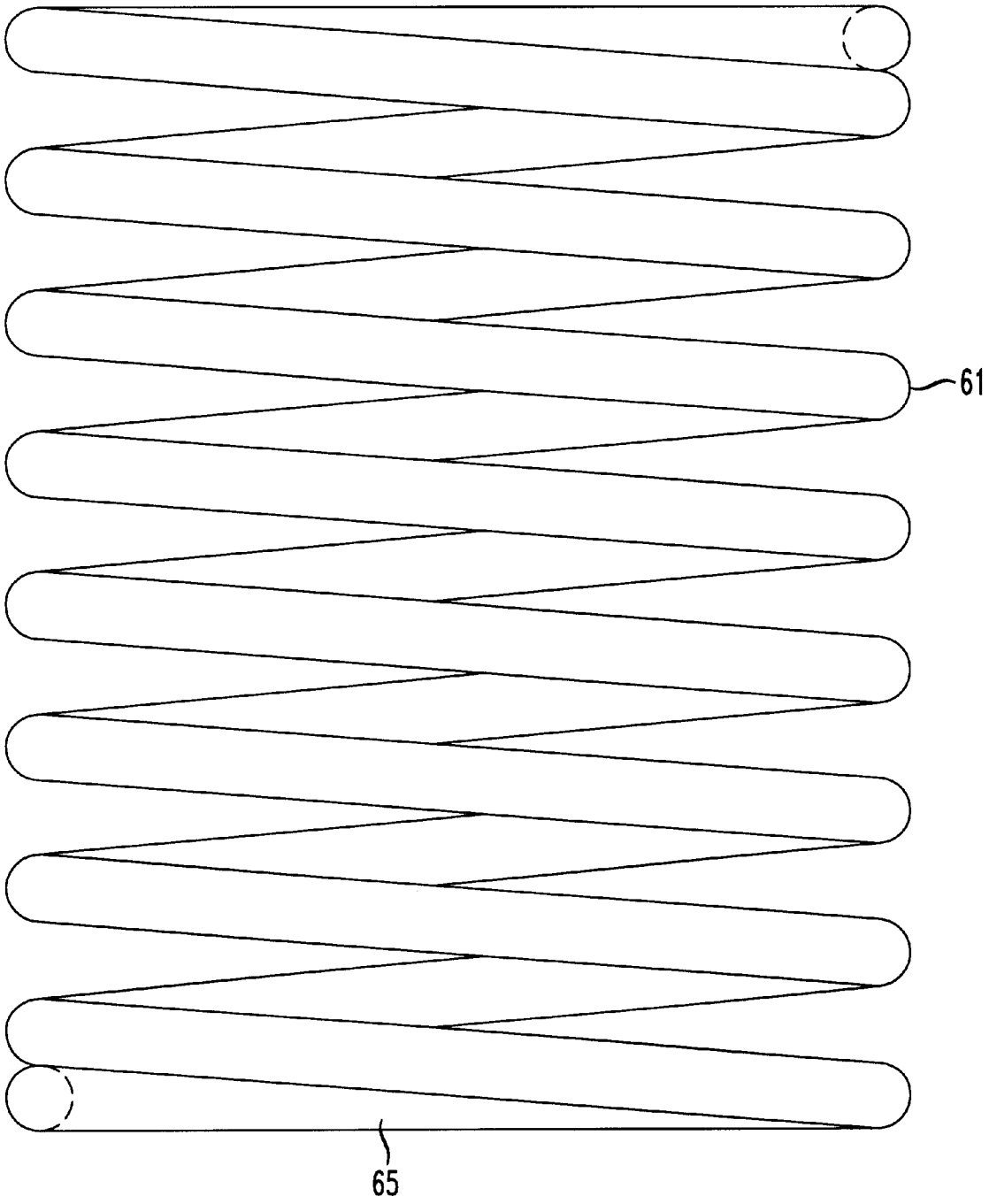

FIG. 23 is a plan view of the pop-up spring.

DESCRIPTION

Figure 1:
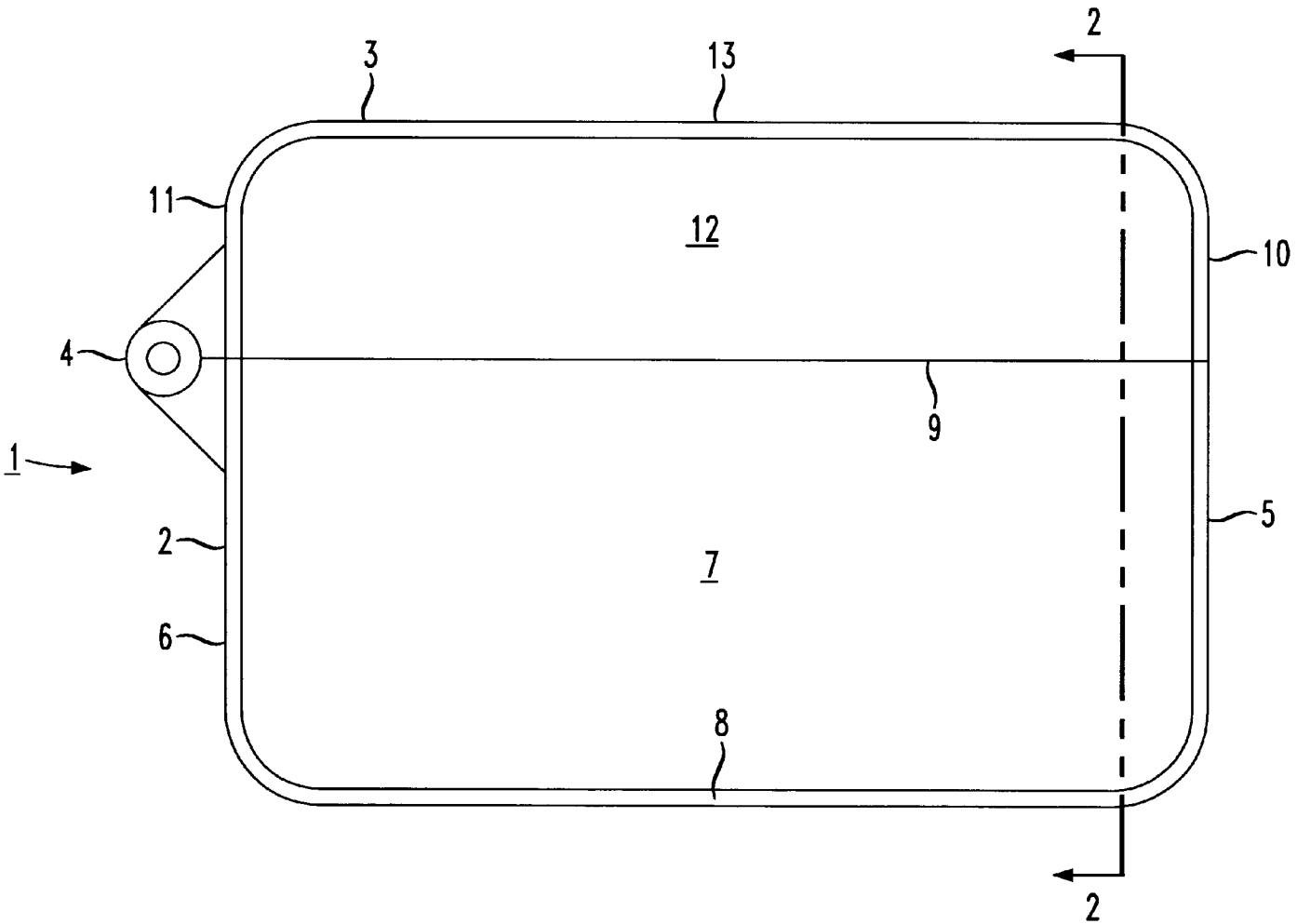
FIG. 1 is a diagrammatic view of a box made in accordance with the present invention.
Figure 2:
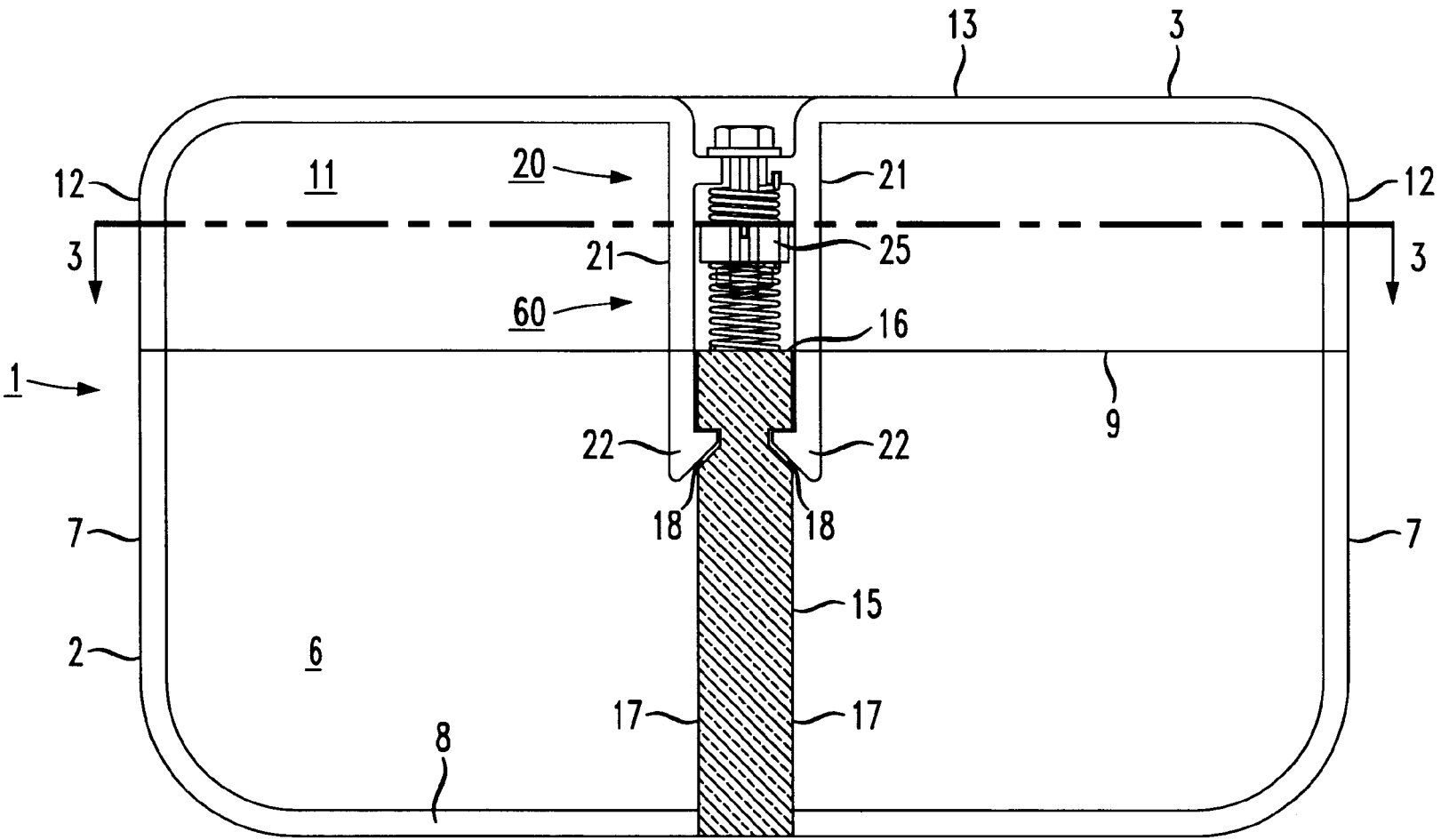
FIG. 2 is a diagrammatic and schematic interior view of the box as seen from line 2—2 of FIG. 1 showing the position of the parts when the box is closed.
Figure 3:
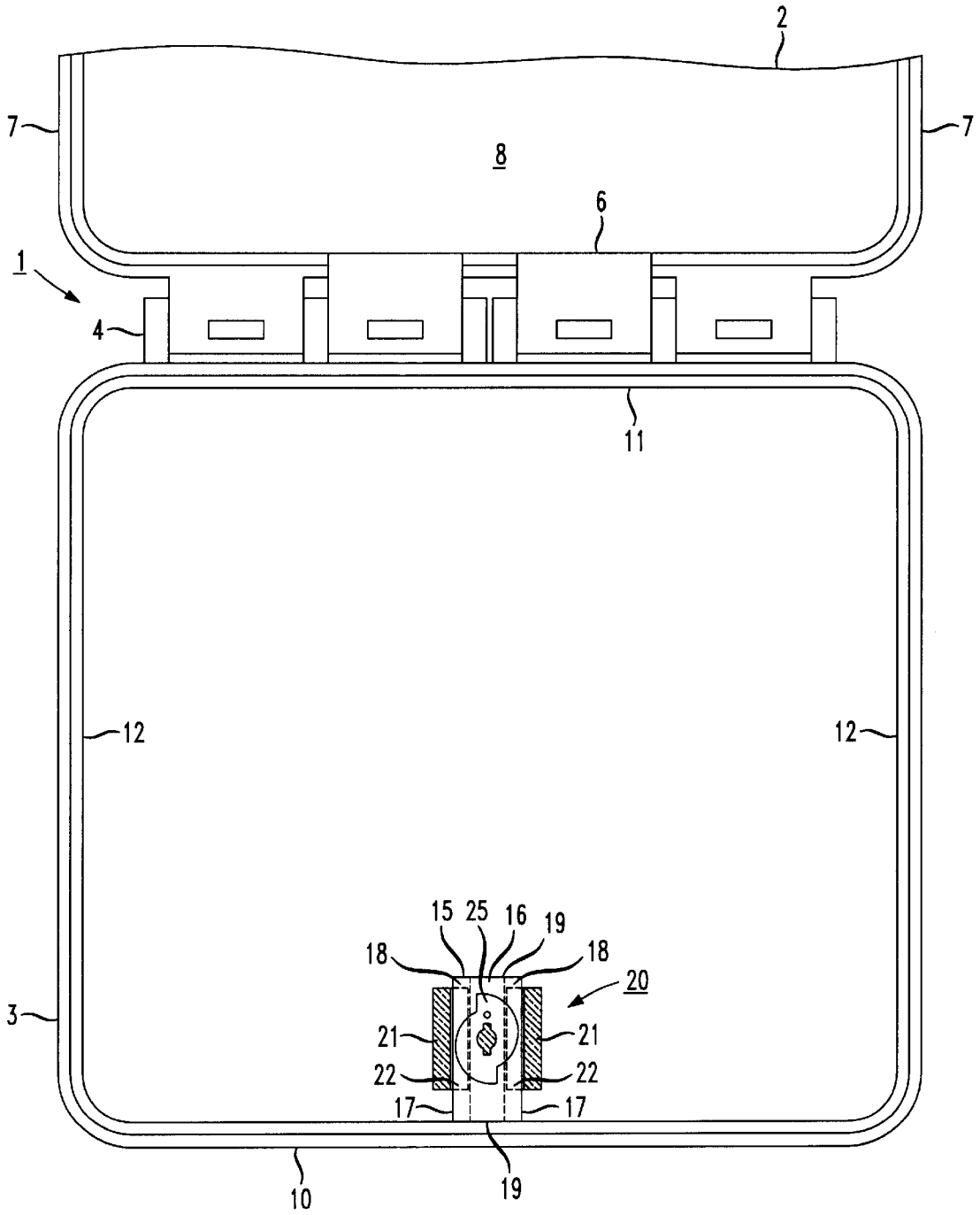
FIG. 3 is a diagrammatic and schematic interior view of the box as seen from line 3—3 of FIG. 2.

Referring to the drawings, the junction box 1 in which the present invention is used comprises a base 2 and a cover 3 attached to the base 2 by means of a hinge assembly 4. As shown in FIGS. 1 to 3, the base 2 has front and rear walls 5 and 6, respectively, a pair of side walls 7 and a bottom panel 8 from which the walls 5, 6 and 7 extend at substantially right angles thereto and which terminates an upper edge 9. The cover 3 is provided with front and rear walls 10 and 11 respectively, a pair of side walls 12, and a top panel 13 from which the walls 10, 11 and 12 extend at substantially right angles thereto.

Adjacent to the front wall 5, the base 2 is provided with an upstanding latch column 15 on latching assembly. The latch column 15 extends from the bottom panel 8 (on which it is mounted) up to approximately the upper edge 9 of the walls 5, 6 and 7. However, it will be understood that the height of this latch column 15 may be changed without departing from the invention. The latch column 15 has an upper edge 16 (substantially at the same level as the upper edge 9 of the base 2), opposed side walls 17 and opposed front and rear walls 19. Slightly below its upper edge 16, the latch column 15 is provided with a pair of opposed retaining grooves 18 extending inwardly from each side wall 17 thereof and preferably extending for the entire depth of the latch column 15 between front and rear walls 19. In the drawings, the retaining grooves 18 have been shown as being substantially v-shaped. However, it will be understood that the retaining grooves 18 may assume any desired shape.

Figure 4:
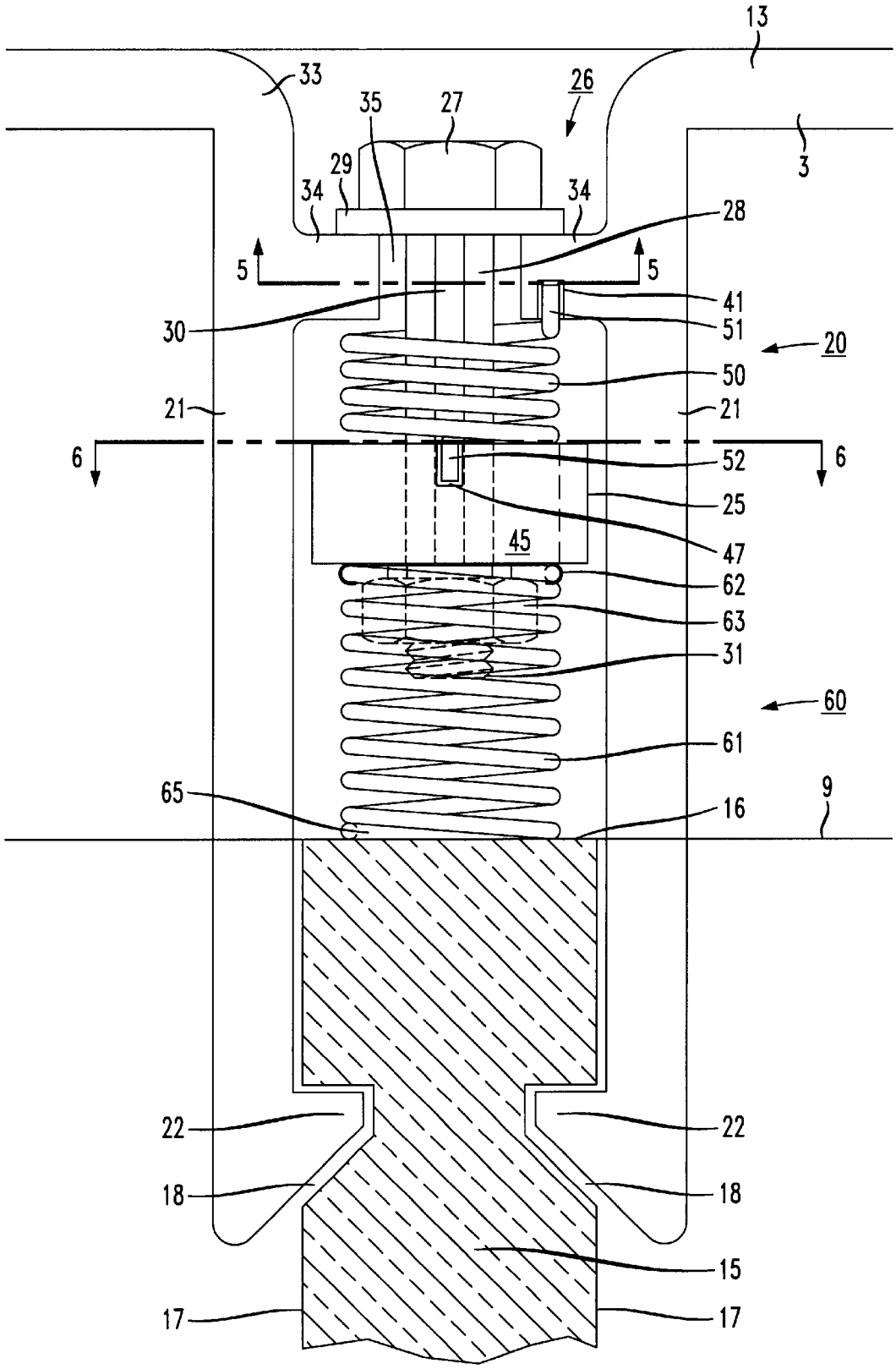
FIG. 4 is an enlarged fragmentary view partly in section of the locking assembly of the present invention showing the position of the parts when the box is closed.

Best shown in FIG. 4, the cover 3 is provided with a locking assembly or latching mechanism 20 depending from the top panel 13 and adjacent to the front wall 10 thereof in overlying relationship to the latch column 15. The locking assembly 20 comprises a pair of spaced and substantially parallel latch arms 21 extending downwardly from the top panel 13 of the cover 3 at substantially right angles thereto to a position below the upper edge 9 of the base 2. In the drawings, the latch arms 21 are shown as being integral with and extending downwardly from the top panel 13. However, it will be understood that, if desired, the latch arms 21 may be a separate unit mounted on the cover 13. Each latch arm 21 has lock prong 22 extending inwardly from its lower end which is adapted to enter into latching engagement with the retaining grooves 18 in the latching column 15 to lock the cover 3 onto the base 2 and keep the box 1 closed. Preferably, the lock prongs 22 are substantially the same shape as the retaining grooves 18 in the latching column 15. The latch arms 21 are resilient so that if they are spread apart and then released, they will snap back to their original perpendicular and parallel latching position shown in FIG. 2.

A control cam or unlatching mechanism 25, best shown in FIGS. 12, 18 and 19, is provided to control the position of the latch arms 21. The control cam 25 will spread the latch arms 21 apart (FIGS. 7, 8, 9 and 11) when rotated in one direction to move each lock prong 22 out of its retaining groove 18 to disengage the latch arms 21 from the latch column 15 which will release the cover 3 and permit it to be opened relative to the base 2. When the control cam 25 is rotated in the opposite direction, (FIGS. 2, 3, 4 and 6) the latch arms 21 will snap back and resume their original perpendicular and parallel latching position. With the latch arms 21 in this position, as soon as the cover 3 is closed, the latch arms 21 are placed into latching engagement with latch column 15 and the lock prongs 22 will snap into retaining grooves 18 thereby automatically locking the box 1 in its closed position.

Best shown in FIGS. 18 and 19, the control cam 25 comprises a central body 45 and a pair of cam faces 46 extending diametrically outwardly therefrom. The diameter of the central body 45 is less than the distance between the latch arms 21 when they are at rest (see FIGS. 2, 3, 4 and 6) and not contact nor affect the position of the latch arms 21. However, the distance between its cam faces 46 is greater than the distance between the latch arms 21 so that when the control cam 25 is rotated the cam faces 46 are turned 90 degrees and strike the latch arms 21 to move them outwardly until the lock prongs 22 are moved out of the retaining grooves 18 (FIGS. 7, 8, 9 and 11) thereby unlocking the cover 3 and permitting it to be opened. When the control cam 25 is rotated, back to its original position, cam faces 46 are moved back to the position in FIGS. 2, 3, 4 and 6, and since the latch arms 21 are no longer being spread apart by the cam faces 46, they will snap back into their original parallel and perpendicular position of FIGS. 2, 3, 4 and 6. The control cam 25 has a circular control opening 48 with female arms 49 extending diametrically therefrom. The control cam 25 also has a spring anchor hole 47 therein spaced from the central body 45 for a purpose which will be discussed in greater detail hereinbelow.

Figure 5:
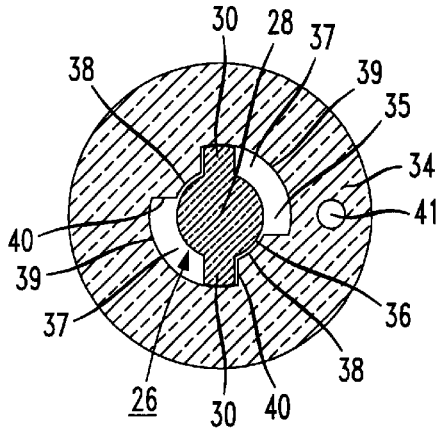
FIG. 5 is an enlarged sectional view taken along line 5—5 of FIG. 4.
Figure 10:
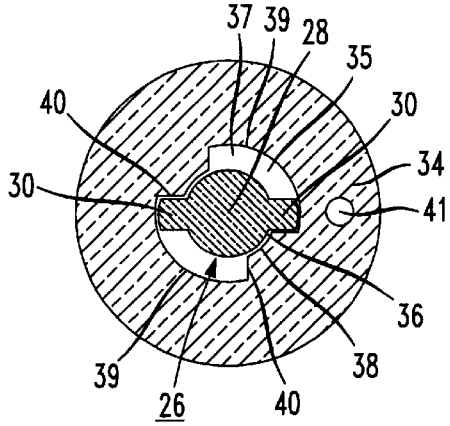
FIG. 10 is an enlarged sectional view taken along line 10—10 of FIG. 9.

A control bolt 26, as shown in FIGS. 13 and 14, is provided to control the position of the control cam 25. The control bolt 26 comprises the usual hexagonal head 27, an integral support ring 29 therebelow, an elongated circular body portion 28 and a threaded free end 31. The control bolt 26 may be a security type bolt having a hexagonal head 27 that requires a special security tool to engage or disengage the bolt, generally known to one skilled in the art (not shown). The control bolt 26 has a pair of diametrically opposed elongated keys 30 extending length-wise from diametrically opposed sides of its body portion 28. As shown in FIGS. 2 and 4, the cover 13 preferably has a counter-sunk area 33 providing a support ledge 34 below the surface of the cover 13. Best shown in FIG. 15, the ledge 34 has an opening 35 therein which comprises a circular center portion 36 and diametrically opposed spaced arcuate side portions 37. As shown in FIGS. 5 and 10, the center portion 36 has curved edges 38 which conform to the curvature of the body portion 28 of the bolt 26. The arcuate side portions 37 have curved outer edges 39 with stop end edges 40. The diametrical distance between the curved outer edges 39 is substantially equal to the diametrical distance between the keys 30. A spring anchor hole 41 is provided in the support ledge 34 spaced from the bolt-receiving opening 35.

Figure 9:
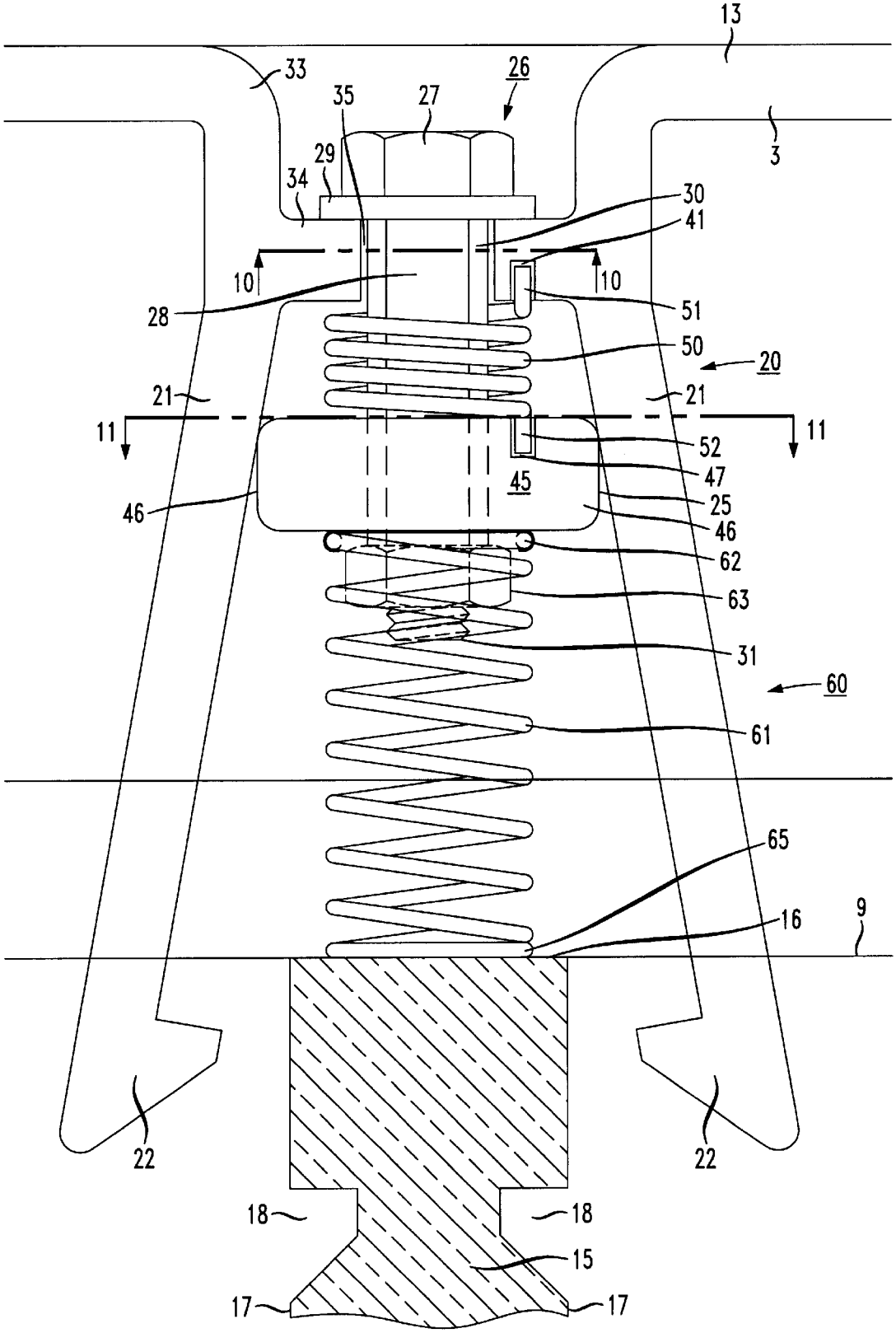
FIG. 9 is an enlarged fragmentary view partly in section of the locking assembly of the present invention showing the position of the parts when the box is open.

As shown in FIGS. 4 and 9, the control bolt 26 extends through opening 35 in support ledge 34 with its main body portion 28 seated in the center 36 and its two keys 30 extending into the arcuate side portions 37. The support ring 29 rests on the support ledge 34 with the top of the head 27 below the level of the top panel 13 of cover 3. When the control bolt 26 is rotated, the stop end edges 40 in the arcuate side portions 37 will limit rotation of the bolt 26 to a ninety degree angle in either direction. The control bolt 26 also enters the opening 48 in the control cam 25 with its keys 30 extending into the female arms 49 so that when the bolt 26 is rotated the cam 25 will also rotate. With this arrangement when the bolt is rotated in one direction the control cam 25 is rotated 90 degrees causing its cam faces 46 to strike the latch arms 21 to spread them apart and move the lock prongs 22 out of the retaining grooves 18 (as shown in FIGS. 7, 8, 9 and 11). When the control cam rotates back to its original position its cam faces 46 move away from the latch arms 21 so that they may return to their original positions (as shown in FIGS. 2, 3, 4 and 6).

A wind-up spring 50, best shown in FIGS. 16 and 17, is provided for automatically rotating the control cam 25 back to its original position after the torque on the control bolt 26 is released. The wind-up spring 50 is a coil spring having upper and lower anchoring legs 51 and 52. As shown in FIGS. 4 and 9, the upper anchoring leg 51 is inserted in the anchor hole 41 in the support ledge 34 and the lower anchoring 52 is inserted into the anchor hole 47 in the control cam 25. The wind-up spring 50 is not normally under tension (see FIG. 4). However, when the control cam 25 is rotated in one direction by the control bolt 26 (in order to turn its cam faces 46 90 degrees and to spread the latch arms 21 apart), as shown in FIG. 9, the spring 50 is wound up against its normally unwound condition. Once the torque on the control cam 25 is released (by releasing the control bolt 26) the spring 50 will unwind itself and resume its original position thereby automatically turning the control cam 25 back to its original position and permitting the latch arms 21 to return to their original position, as shown in FIG. 4.

The locking mechanism of the present invention may also include an automatic box opening or pop-up assembly 60 for opening the cover 3 once the latch arms 21 are spread apart to release the cover 3. Best shown in FIG. 20, this pop-up assembly 60 comprises a pop-up spring 61 mounted in and depending from a cap 62 which is attached to the free end 31 of the central bolt 26 by a threaded nut 63. The cap 62 holds the spring 61 in place in a position to overlie the latch column 15 as shown in FIGS. 4 and 9. Best shown in FIGS. 21 and 22, the cap 62 has an opening 64 with side portions 66 extending diametrically therefrom through which the body portion 28 and keys 30 of the control bolt 26 extend. As shown in FIG. 4, when the cover 3 is closed, the lower edge 65 of the spring 61 will contact the top edge 16 of the latch column 15 and be compressed. As soon as the latch arms 21 are spread apart and the cover 3 is released and free to open, the compression on the spring 61 is released and the spring 61 will expand upwardly to open the cover 3 as shown in FIG. 9. While for convenience, the pop-up assembly 60 has been shown as being located axially with the locking assembly 20, it will be understood that the pop-up assembly 60 can be placed elsewhere in the box without departing from the invention.

Figure 6:
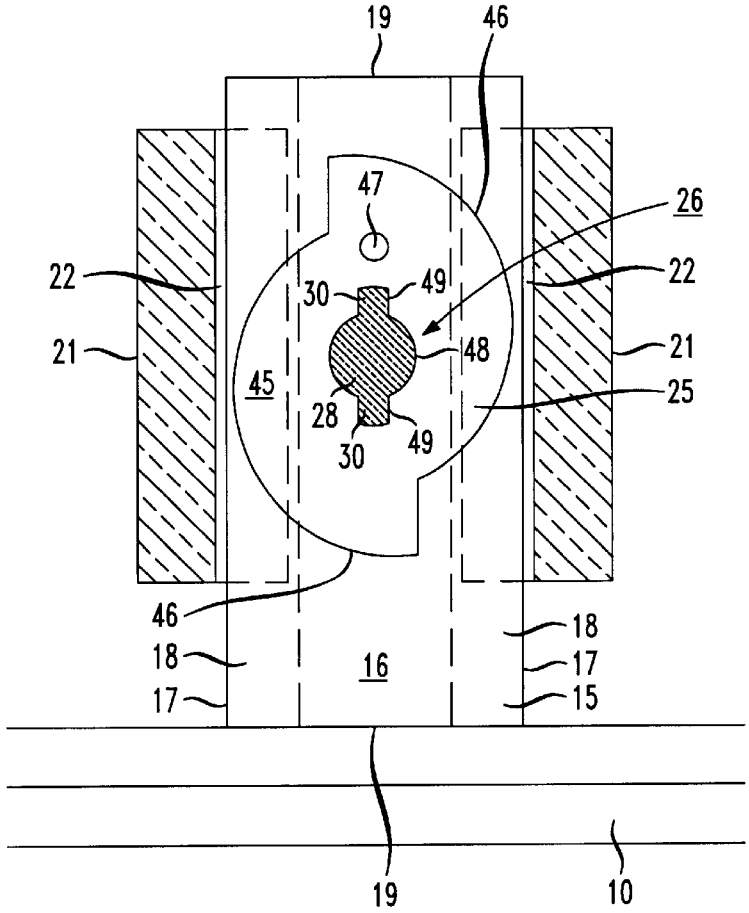
FIG. 6 is an enlarged sectional view taken along line 6—6 of FIG. 4.
Figure 7:
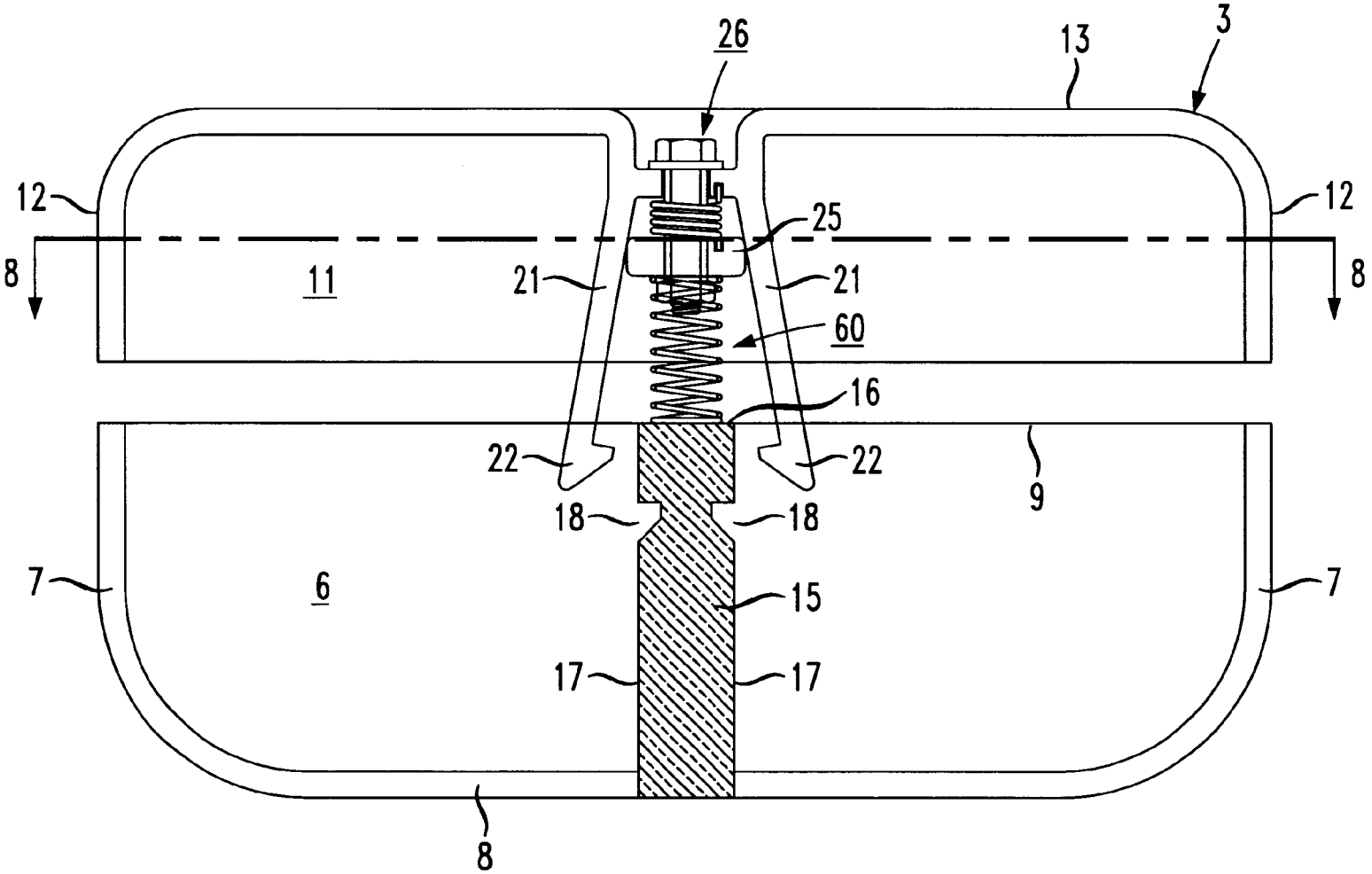
FIG. 7 is a diagrammatic and schematic interior view of the box similar to FIG. 2 showing the position of the parts when the box is open.
Figure 8:
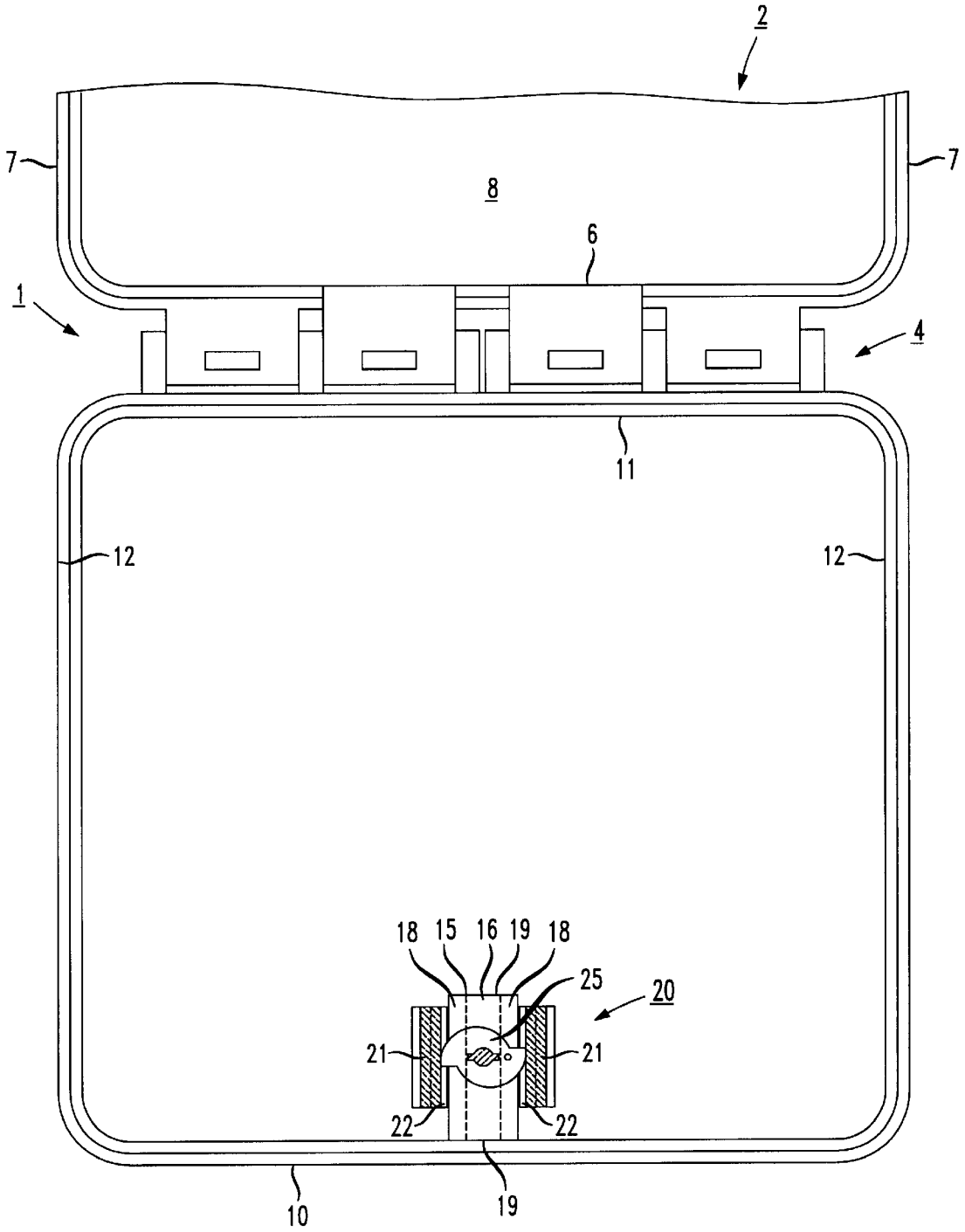
FIG. 8 is a diagrammatic and schematic interior view of the box as seen from line 8—8 of FIG. 7.
Figure 11:
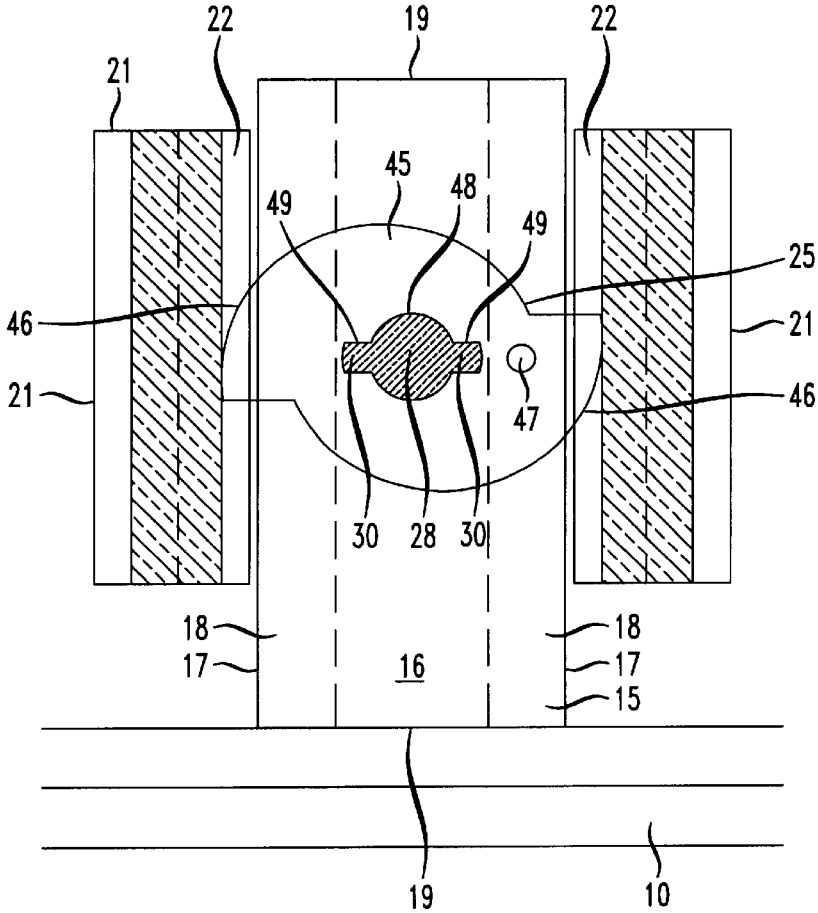
FIG. 11 is an enlarged sectional view taken along line 11—11 of FIG. 9.

In operation, when the cover 3 is closed, the latch arms 21 have their lock prongs 22 positioned in the retaining grooves 18 to hold the cover 3 down. In this position, the pop-up spring 61 is in its compressed position against the upper edge 16 of the latch column 15 and the control cam 25 is in its inactive position (FIGS. 4 and 6) so that it has no effect on the latch arms 21. However, when the control bolt 26 is rotated, the control cam 25 is rotated 90 degrees in one direction to its unlatching position where its cam faces 46 strike the latch arms 21 to spread them apart and to move the lock prongs 22 out of the retaining grooves 18 (FIGS. 9 and 11). This not only releases the cover 3, but also winds-up the wind-up spring 50 and causes the pop-up spring 61 to expand upwardly to automatically open the cover 3. As soon as the torque on the bolt 26 is released the tension on the wind-up spring 50 is also released and the spring 50 unwinds itself back to its original position, thereby rotating the control cam 25 in the opposite direction and moving it back to its original position to free the latch arms 21 from the force of the cam faces 47 and to permit the latch arms 21 to spring back to their original latching position (FIGS. 4 and 6). When the cover 3 is closed, the lock prongs 22 of the latch arms 21 will strike latch column 15 and flex out slightly as they slide over the top 16 and along the sides 17 of the latch column 15 until the lock prongs 22 snap into the retaining grooves 18 thereby locking the cover 3 closed. At the same time, the pop-up spring 61 is compressed onto the top 16 of latch column 15 and is ready to pop the cover 3 open when the latch arms 21 are released at a later time.

It will thus be seen that the present invention provides an automatic locking mechanisms for a junction box which requires a tool to open the box but which would automatically lock the box when the cover is closed without the use of a tool and which will automatically open the box once the cover is unlocked and released.

As many varied modifications of the subject matter of this invention will become apparent to those skilled in the art from the detailed description given hereinabove it will be understood that the present invention is limited only as provided in the claims appended hereto.

Embodiments of the invention in which a particular property or privilege is claimed are as follows:

1. A locking mechanism for a box having a cover and a base hingeably connected to each other, said locking mechanism comprising a cover latching mechanism and a base latching mechanism, at least one of said latching mechanisms being in a latching position, said latching mechanisms being in latching engagement with each other so as to lock the box closed, an unlatching mechanism having a rotatable cam adapted to be actuated to place at least one of said latching mechanisms in an unlatching position to disengage the latching mechanisms from each other so as to unlock the box, an actuating mechanism to actuate said unlatching mechanism, a deactuating mechanism having a wind-up spring responsive to rotation of said cam, said wind-up spring having a first anchoring leg adapted to extend into an anchor opening in the cover and a second anchoring leg extending into an anchor hole in the cam, said spring being placed in tension when said cam is rotated in one direction and automatically springing back to return at least one of said latching mechanisms to its latching position when the rotational force on said cam is released whereby the latching mechanisms will lock in engagement with each other to lock the box in response to the closing of the cover.

2. A locking mechanism as set forth in claim 1 wherein said cover latching mechanism comprises a pair of resilient latch arms adapted to depend from said cover.

3. A locking mechanism as set forth in claim 2 wherein said base latching mechanism comprises a latch column adapted to extend upwardly from said base.

4. A locking mechanism as set forth in claim 3 wherein said latch arms having lock prongs extending inwardly therefrom and wherein said latch column having retaining grooves and said lock prongs are positioned in said retaining grooves in order to lock the cover in place, said latch arms being spread apart in response to the rotation of said cam in one direction, urging said lock prongs out of said retaining grooves and said latch arms returning to their original latching position in response to releasing the rotational force on said cam.

5. A locking mechanism as set forth in claim 4 wherein said actuating mechanism comprises a control bolt for rotating said cam in one said direction.

6. A locking mechanism as set forth in claim 5 wherein said cam has an opening therein and wherein said control bolt extends through said opening, the said control cam and the said control bolt being keyed to each other whereby rotation of the control bolt will rotate the control cam.

7. A locking mechanism as set forth in claim 6 wherein said cam is positioned between said latch arms and has a pair of diametrically opposed cam faces, the distance between said cam faces being greater than the distance between the latch arms whereby rotation of the cam will cause said cam faces to strike the latch arms and spread them apart.

8. A locking mechanism as set forth in claim 7 wherein said cover having a depressed support ledge and wherein said control bolt being adapted to extend through an opening in said depressed support ledge.

9. A locking mechanism as set forth in claim 8 wherein said support ledge being adapted to limit the rotation of said control bolt.

10. A locking mechanism as set forth in claim 9 wherein said control bolt is a security type bolt.

11. A locking mechanism as set forth in claim 1 further comprising a box opening assembly being adapted to open said cover substantially simultaneously as the latching mechanisms are disengaged from each other.

12. A locking mechanism as set forth in claim 11, wherein said box opening assembly comprises a pop-up spring being adapted to extend downwardly from the cover of said box.

13. A locking mechanism as set forth in claim 12 wherein said base latching mechanism comprises a latch column adapted to extend upwardly from said base and wherein said pop-up spring is a compression spring and wherein the lower edge of the compression spring is adapted to overlie and strike the top of said latch column in order to be compressed when the cover is closed.

14. A locking mechanism as set forth in claim 13 wherein said compression spring is mounted on and is in axial alignment with said locking mechanism.

15. A locking mechanism as set forth in claim 14 wherein said actuating mechanism is a control bolt which extends through an opening in said cap.

16. A locking mechanism as set forth in claim 13 wherein a cap is provided from which the compression spring depends, and wherein said cap is mounted on said actuating mechanism.

17. A box having a cover and a base hingeably connected to each other, a locking mechanism cooperating with the base and cover to lock the box in a closed position, said locking mechanism comprising a cover latching mechanism and a base latching mechanism, at least one of said latching mechanisms being in a latching position, said latching mechanisms being in latching engagement with each other so as to lock the box closed, an unlocking mechanism in the box to unlock the box, said unlocking mechanism having a rotatable cam adapted to be actuated to place at least one of said latching mechanisms in an unlatching position to disengage the latching mechanisms from each other so as to unlock the box, an actuating mechanism to actuate said unlocking mechanism, a deactuating mechanism having a wind-up spring responsive to rotation of said cam, said spring being placed in tension when said cam is rotated in one direction and automatically springing back to return at least one of said latching mechanisms to its latching position when the rotational force on said cam is released whereby the latching mechanisms will lock in engagement with each other to lock the box in response to the closing of the cover, a box opening assembly in said box, said box opening assembly being adapted to open the cover as soon as the box is unlocked.

18. A box as set forth in claim 17 wherein said box opening assembly comprises a pop-up spring.

19. A box as set forth in claim 18 wherein said pop-up spring is a compression spring and wherein the lower edge of the compression spring is adapted to overlie and strike a portion of the base and be compressed when the cover is closed.

20. A box as set forth in claim 19 wherein said compression spring is mounted on and depends from the cover.

21. A box as set forth in claim 20 wherein a cap is provided from which the compression spring depends, said cap being mounted on said unlocking mechanism.

* * * * *